US007153219B2

(12) United States Patent
Reed et al.

(10) Patent No.: US 7,153,219 B2
(45) Date of Patent: Dec. 26, 2006

(54) GOLF CLUB HEAD

(75) Inventors: Tim Reed, Allen, TX (US); Michael Vrska, Allen, TX (US); Oliver G. Brewer, III, Plano, TX (US)

(73) Assignee: Adams Golf IP, L.P., Plano, TX (US)

( * ) Notice: Subject to any disclaimer, the term of this patent is extended or adjusted under 35 U.S.C. 154(b) by 16 days.

(21) Appl. No.: 10/866,188

(22) Filed: Jun. 14, 2004

(65) Prior Publication Data

US 2005/0277484 A1 Dec. 15, 2005

(51) Int. Cl.
*A63B 53/00* (2006.01)
*A63B 53/04* (2006.01)
*A63B 53/06* (2006.01)

(52) U.S. Cl. ..... 473/290; 473/349; 473/350

(58) Field of Classification Search ..... 473/324–350
See application file for complete search history.

(56) References Cited

U.S. PATENT DOCUMENTS

| | | | | |
|---|---|---|---|---|
| 2,846,228 | A | 8/1958 | Reach | |
| 4,523,759 | A | 6/1985 | Igarashi | |
| 4,645,207 | A * | 2/1987 | Teramoto et al. | 473/290 |
| 4,653,756 | A * | 3/1987 | Sato | 473/327 |
| 4,798,383 | A | 1/1989 | Nagasaki et al. | |
| 4,992,236 | A | 2/1991 | Shira | |
| 5,062,638 | A | 11/1991 | Shira | |
| 5,074,563 | A | 12/1991 | Gorman | |
| 5,290,036 | A * | 3/1994 | Fenton et al. | 473/332 |
| 5,486,000 | A | 1/1996 | Chorne | |
| 5,492,327 | A | 2/1996 | Biafore, Jr. | |
| 5,540,436 | A | 7/1996 | Boone | |
| 5,547,427 | A * | 8/1996 | Rigal et al. | 473/345 |
| 5,584,770 | A * | 12/1996 | Jensen | 473/350 |
| 5,586,947 | A * | 12/1996 | Hutin | 473/324 |
| 5,643,112 | A | 7/1997 | Besnard et al. | |
| 5,669,826 | A * | 9/1997 | Chang et al. | 473/332 |
| 5,749,794 | A | 5/1998 | Kobayashi et al. | |
| 5,772,527 | A | 6/1998 | Liu | |
| 6,179,726 | B1 * | 1/2001 | Satoh et al. | 473/290 |
| 6,200,228 | B1 | 3/2001 | Takeda | |
| 6,206,790 | B1 | 3/2001 | Kubica et al. | |
| 6,551,200 | B1 | 4/2003 | Golden et al. | |
| 6,769,998 | B1 | 8/2004 | Clausen et al. | |
| 6,780,123 | B1 | 8/2004 | Hasebe | |
| 6,814,674 | B1 | 11/2004 | Clausen et al. | |
| 6,857,973 | B1 | 2/2005 | Wieland et al. | |
| 6,863,625 | B1 | 3/2005 | Reyes et al. | |

(Continued)

FOREIGN PATENT DOCUMENTS

JP 2000325509 A * 11/2000

(Continued)

OTHER PUBLICATIONS

Jackson, Jeff. Modern Guide to Golf Clubmaking. Ohio: Dynacraft Golf Products, copyright 1987, p. 237-239.*

(Continued)

*Primary Examiner*—Eugene Kim
*Assistant Examiner*—Alvin A. Hunter, Jr.
(74) *Attorney, Agent, or Firm*—Welsh & Flaxman LLC

(57) ABSTRACT

An iron type golf club head includes a primary club head body composed of metal. The primary club head body includes a striking face and a facing wall opposite the striking face. The club head also includes a polymeric body secured to the facing wall of the primary club head body, wherein the polymeric body is secured opposite the striking face of the primary club head body.

1 Claim, 7 Drawing Sheets

U.S. PATENT DOCUMENTS

| | | | |
|---|---|---|---|
| 6,874,674 | B1 | 4/2005 | Jacksen et al. |
| 6,887,164 | B1 | 5/2005 | Dewanjee et al. |
| 6,981,924 | B1 | 1/2006 | Deshmukh |
| 6,984,180 | B1 | 1/2006 | Hasebe |
| 7,004,853 | B1 | 2/2006 | Deshmukh |
| 2001/0007834 | A1 | 7/2001 | Gates |
| 2001/0055996 | A1 | 12/2001 | Iwata et al. |
| 2002/0004429 | A1 | 1/2002 | Wu et al. |
| 2002/0082118 | A1 | 6/2002 | Iwata et al. |
| 2003/0022729 | A1 | 1/2003 | Pergande et al. |
| 2003/0092502 | A1 | 5/2003 | Pergande et al. |
| 2004/0023730 | A1 | 2/2004 | Nagai et al. |
| 2005/0044691 | A1 | 3/2005 | Su |
| 2005/0054458 | A1 | 3/2005 | Chen |
| 2005/0075190 | A1 | 4/2005 | Deshmukh |
| 2005/0130760 | A1 | 6/2005 | Deshmukh |
| 2005/0130765 | A1 | 6/2005 | Wieland et al. |
| 2005/0170908 | A1 | 8/2005 | Reyes et al. |
| 2005/0255938 | A1 | 11/2005 | Soracco |
| 2006/0003852 | A1 | 1/2006 | Hou |
| 2006/0035721 | A1 | 2/2006 | Knutson et al. |
| 2006/0052183 | A1 | 3/2006 | Soracco et al. |
| 2006/0052184 | A1 | 3/2006 | Soracco et al. |

FOREIGN PATENT DOCUMENTS

| | | | |
|---|---|---|---|
| JP | 2001340501 | A * | 12/2001 |
| JP | 2003199850 | A * | 7/2003 |

OTHER PUBLICATIONS

Callister, Jr., William D., Material Science and Engineering: An Introduction, Fourth Edition. New York: John Wiley & Sons, Inc., copyright 1997, pp. 775 and 776.*

* cited by examiner

GOLF CLUB HEAD

BACKGROUND OF THE INVENTION

1. Field of the Invention

The invention relates to a golf club head. More particularly, the invention relates to an iron type golf club head having an upper portion thereof formed from a cast polymer material.

2. Description of the Prior Art

Golf club manufacturers are consistently attempting to design golf clubs that are easier to hit and offer golfers greater forgiveness when the ball is not struck directly upon the sweet spot of the striking face. As those skilled in the art will certainly appreciate, many designs have been developed and proposed for assisting golfers in learning and mastering the very difficult game of golf.

With regard to iron type club heads, cavity back club heads have been developed for mid to high handicap golfers, who find it difficult to squarely hit the golf ball and generate the force necessary to lift the golf ball into the air. Cavity back golf clubs achieve this goal by shifting the weight of the club head toward the outer perimeter thereof. By shifting the weight in this manner, the center of gravity of the club head is pushed toward the sole of the club head, thereby providing a club head that is easier to use in striking a golf ball. In addition, weight is shifted to the toe and heel of the club head, which helps to expand the sweet spot and assist the golfer when a ball is struck slightly off center.

As club manufacturers have learned to assist higher handicap golfers by shifting the center of gravity toward the sole of the club head, a wide variety of designs have been developed. Unfortunately, many of these designs substantially alter the appearance of the club head while attempting to shift the center of gravity toward the sole and perimeter of the club head. This is highly undesirable as golfers become familiar with a certain style of club head and alteration of that style often adversely affects their mental outlook when standing above a ball and aligning the club head with the ball. As such, a need exists for an improved club head which achieves the goal of shifting the center of gravity further toward the sole and perimeter of the club head without substantially altering the appearance of a traditional cavity back club head with which golfers have become comfortable. The present invention provides such a club head.

SUMMARY OF THE INVENTION

It is, therefore, an object of the present invention to provide an iron type golf club head. The club head includes a primary club head body composed of metal. The primary club head body includes a striking face and a facing wall opposite the striking face. The club head also includes a polymeric body secured to the facing wall of the primary club head body, wherein the polymeric body is secured opposite the striking face of the primary club head body.

It is also an object of the present invention to provide a method for forming an iron type golf club head. The method is achieved by forming a primary club head body composed of metal, the primary club head body including a striking face and a facing wall opposite the striking face, forming a polymeric body shaped and dimensioned for attachment along the facing wall of the primary club head body, and securing to the polymeric body to the facing wall of the primary club head body.

It is a further object of the present invention to provide an iron type golf club head including a primary club head body composed of metal having a first density. The primary club head body includes a striking face and a facing wall opposite the striking face. The club head also includes a secondary body secured to the facing wall of the primary club head body, the secondary body having a second density that is less than the first density of the primary club head body.

It is still another object of the present invention to provide an iron type golf club head having a center of gravity positioned at Y=0.200" to 0.680", Z=0.075" to 0.700" and X=0.750" to 1.750", wherein XYZ coordinates are set from a hosel center line and a ground intersection plane, Y being the vertical center of gravity (CG) height measured from the ground plane, Z being the horizontal depth of the CG measured from a vertical plane tangent through the hosel center line and generally parallel with the leading edge of the face, and X being the lateral distance from a vertical plane about the intersection of the hosel center line and the ground plane and a mass of approximately 200 g to approximately 310 g. The club head includes a primary club head body composed of metal having a first density. The primary club head body includes a striking face having a surface area of approximately 2 $in^2$ to approximately 7 $in^2$ and a facing wall opposite the striking face. The club head also includes a secondary body secured to the primary club head body, the secondary body having a second density that is less than the first density of the primary club head body.

It is also another object of the present invention provide an iron type golf club head including a primary club head body composed of metal having a first density. The primary club head body includes a striking face and a rear surface opposite the striking face, the rear surface including a facing wall substantially parallel to the striking face and a lip along at least a portion of the rear surface and extending transverse to and adjacent to the facing surface. The club head also includes a secondary body secured to the rear surface of the primary club head body, the secondary body having a second density that is less than the first density of the primary club head body. The secondary body further includes a forward surface abutting the facing surface of the primary club head body and a coupling surface extending transverse and adjacent to the forward surface and being shaped and dimensioned for substantial alignment with the lip along the rear surface of the primary club head body. The secondary body is mounted along the facing wall and the lip of the rear surface.

It yet another object of the present invention to provide an iron type golf club head including a primary club head body composed of metal. The primary club head body includes a striking face having a loft angle, a facing wall opposite the striking face and a sole extending between the striking face and a rear portion of the primary club head body. The club head also includes a secondary body secured to the facing wall of the primary club head body, the secondary body having a second density that is less than the first density of the primary club head body. The loft angle is between approximately 16° and 50° and the sole thickness is between approximately 0.900 inches and 2.975 inches.

It is also an object of the present invention to provide a set of iron type golf clubs. The set includes a plurality of iron type golf clubs, each iron type golf club including a shaft and a club head secured thereto. Each club head includes a primary club head body composed of metal. The primary club head body includes a striking face having a loft angle, a facing wall opposite the striking face and a sole extending between the striking face and a rear portion of the primary club head body. The club head also includes a secondary body secured to the facing wall of the primary club head body, the secondary body having a second density that is less than the first density of the primary club head body. The loft angle is between approximately 16° and 50° and the sole thickness is between approximately 0.900 inches and 2.975 inches.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
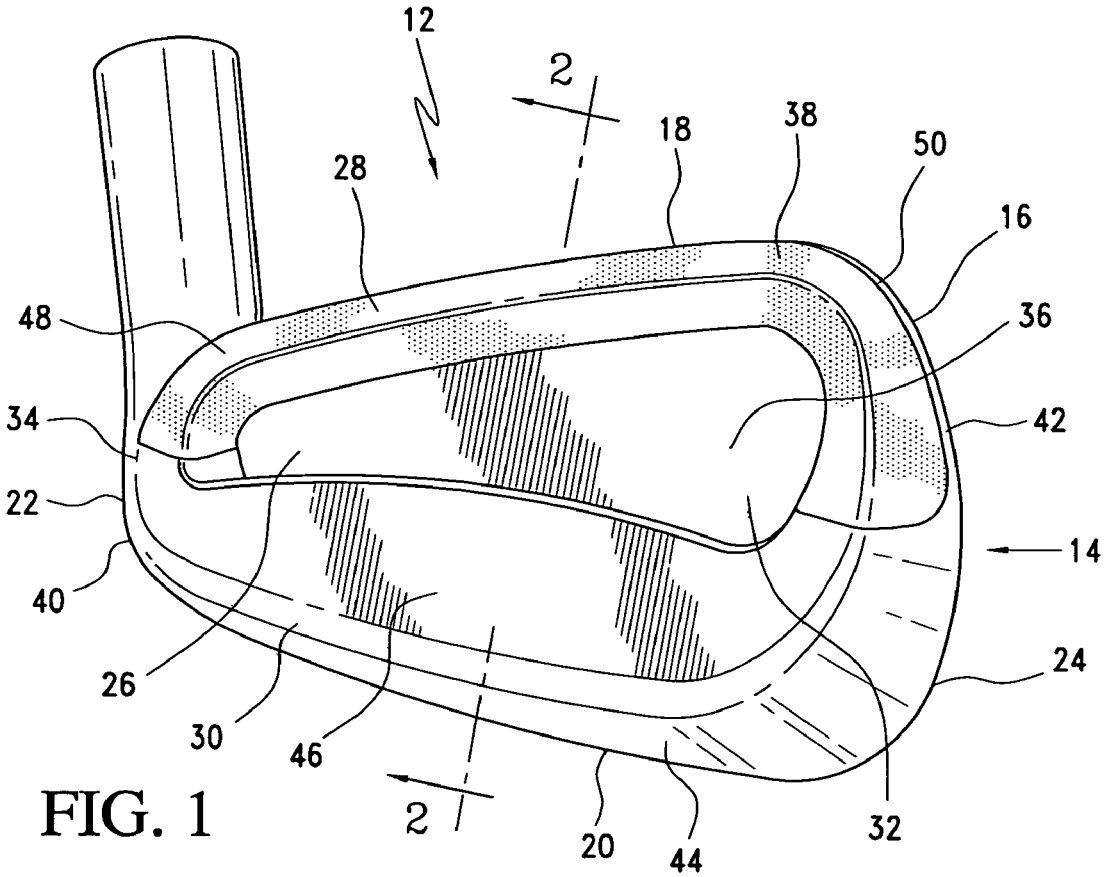
FIG. 1 is a rear perspective view of a club head in accordance with the present invention.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to FIGS. 1, 2, 3, 4 and 5, a club head 12 in accordance with the present invention is disclosed. The iron type golf club head 12 includes a club head body 14 having a striking face 16 with a plurality of scorelines 17, a top line 18 defining the upper limit of the striking face 16, a sole portion 20 defining the lower limit of the striking face 16, a heel 22, a toe 24 and a rear surface 26 opposite the striking face 16. The rear surface 26 has a cavity back construction and includes an upper section 28 adjacent the top line 18, a lower section 30 adjacent the sole portion 20 and a middle section 32 between the upper section 28 and the lower section 30.

As mentioned above, the club head 12 has the general configuration of a cavity back club head and, consequently, the rear surface 26 includes a flange 34 extending rearwardly around the periphery of the club head body 14. The rearwardly extending flange 34 defines a cavity 36 within the rear surface 26 of the club head body 14. The flange 34 includes a top flange 38 extending rearwardly along the top line 18 of the club head body 14 adjacent the upper section 28. The top flange 38 extends the length of the top line 18 from the heel 22 of the club head body 14 to the toe 24 of the club head body 14. The club head body 14 is further provided with rearwardly extending flanges 40,42 along the heel 22 (that is, a heel flange 40) and the toe 24 (that is, the toe flange 42) of the club head body 14. These rearwardly extending flanges 38, 40, 42 extend through the upper section 28, lower section 30 and middle section 32 of the rear surface 26 of the club head 12. Finally, the club head body 14 is provided with a bottom flange 44 extending along the sole portion 20 of the club head body 14.

In an effort to reduce the weight associated with the upper section 28 of the club head 12, the upper section 28 of the rear surface 26 adjacent the top line 18 is formed from a cast polymeric material. That is, the top line of the club head 12 is replaced with a polymeric upper section 28. As such, the club head 12 may be thought of as including a primary body 46 and a polymeric secondary body 48 composed of the polymeric upper section 28.

In accordance with a preferred embodiment of the invention, the polymeric material is a plastic, urethane or rubber. However, other polymeric materials may be utilized without departing from the spirit of the present invention. While a polymeric body is disclosed in accordance with a preferred embodiment, other lightweight materials may be used without departing from the spirit of the present invention. For example, it is contemplated that plastic, aluminum, magnesium, urethane, carbon, rubber, or other similar metallic or non-metallic materials may be employed within the spirit of the present invention. As the upper section 28, that is, the secondary body 48, is constructed from a polymeric material, and the upper section 28 includes the top flange 38, as well as a portion of the toe flange 42 and portions of the toe flange 42 are formed from polymeric material.

The secondary body 48 is approximately positioned between the uppermost scoreline and the top line 18 of the club head 12 along the rear surface 26 thereof. More particularly, and in accordance with a preferred embodiment of the present invention, the scorelines 17 includes full length scorelines 17*a* which extend from near the sole portion 20 to the middle of the striking face 16 and partial length scorelines 17*b* which extend from the middle of the striking face 16 toward the apex of the striking face 16 as the striking face 16 narrows between the heel 22 and toe 24 of the club head 12. With this perspective in mind, the polymeric secondary body 48 is preferably approximately positioned between the full-length scorelines 17*a* and the top line 18 of the club head 12 along the rear surface 26 thereof.

Figure 6:
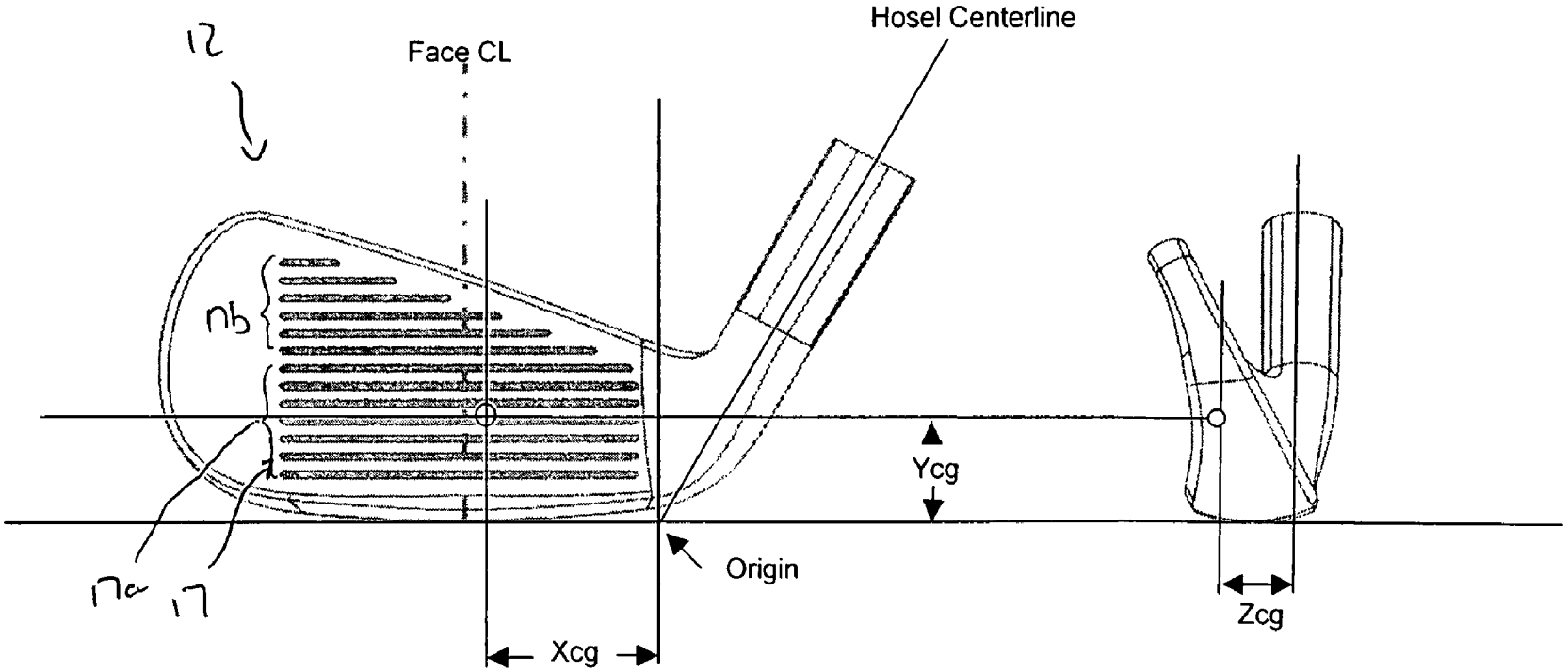
FIG. 6 is a schematic of the present club head showing X, Y & Z definition criteria for the present club head.

While the secondary body 48 in accordance with a preferred embodiment of the present invention fully extends from the heel 22 to the toe 24, it is contemplated the secondary body 48 should extend at least one inch toward the heel 22 and one inch toward the toe 24 from a face center line ("CL") extending vertically through the striking face 16, wherein the face center line is centrally positioned along the full length scorelines 17*a* (see FIG. 6).

Figure 2:
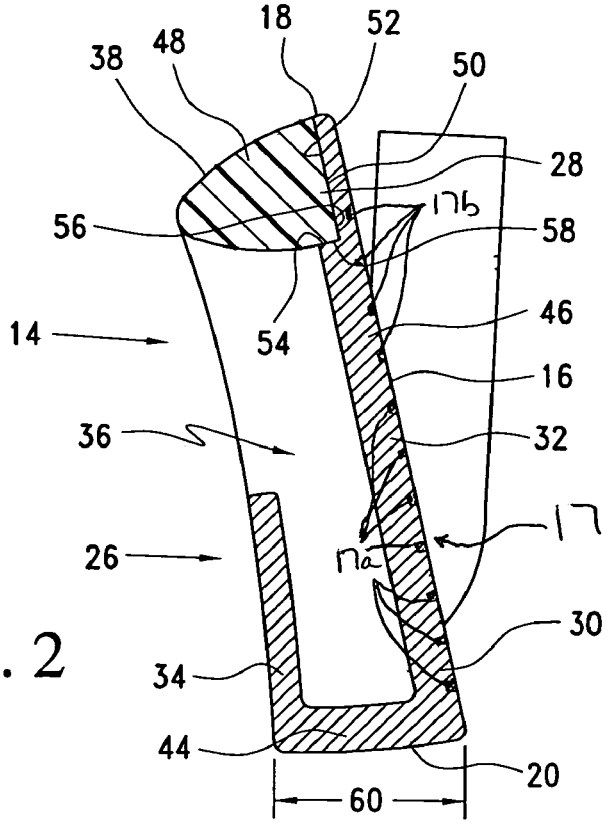
FIG. 2 is a cross sectional view of the club head shown in FIG. 1.
Figure 3:
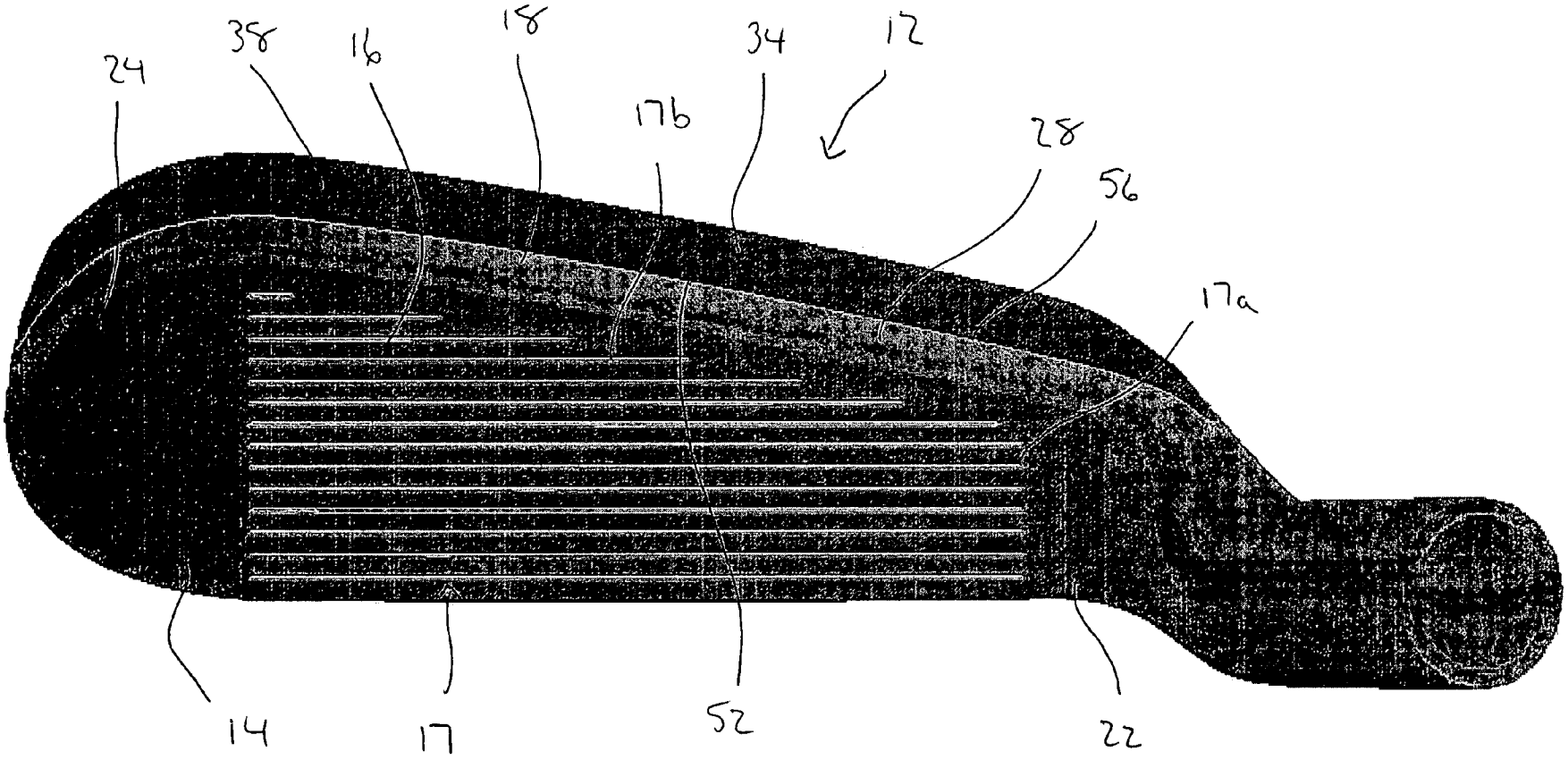
FIG. 3 is a top view of the club head.
Figure 4:
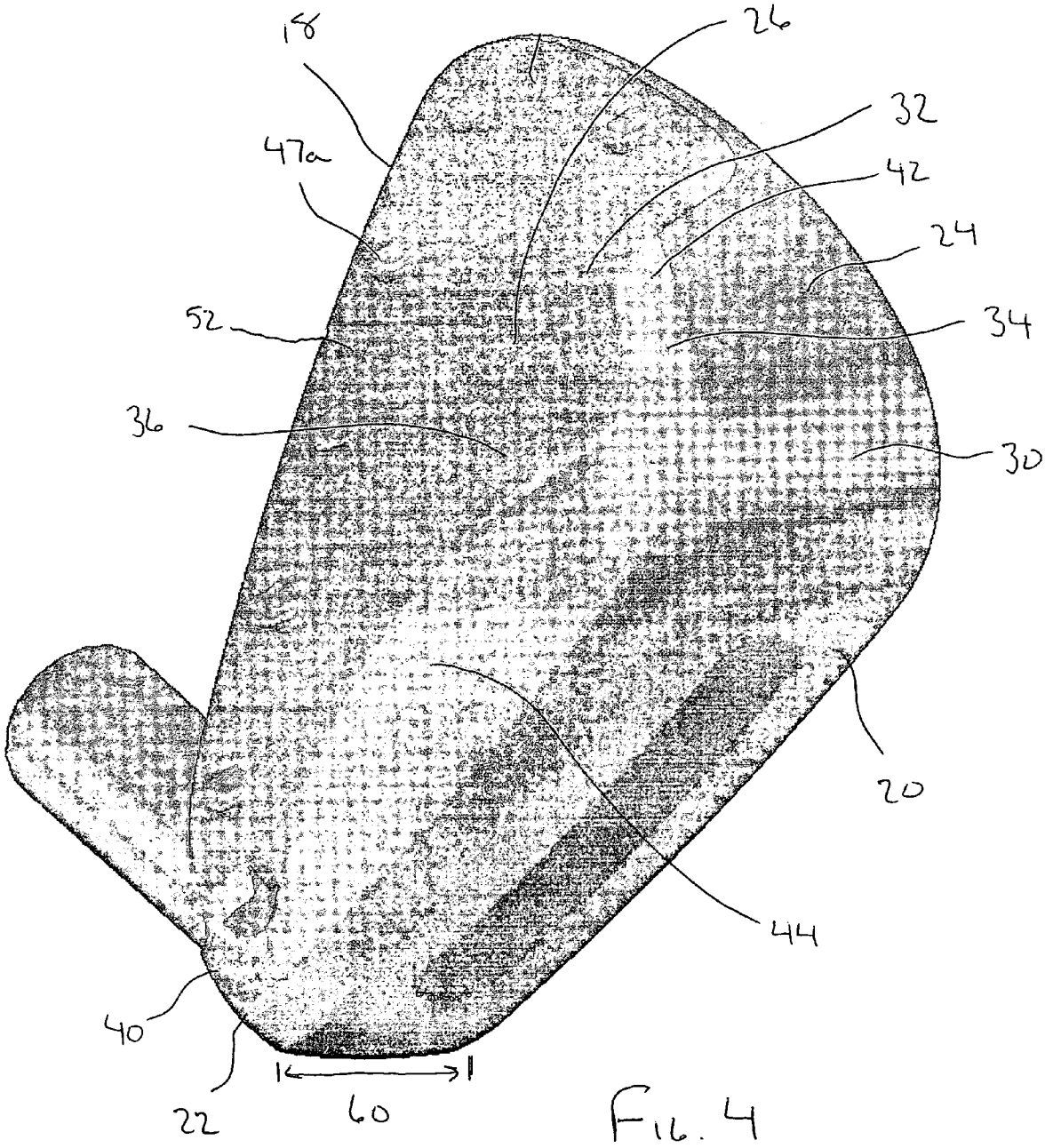
FIGS. 4 and 5 are respectively perspective views of the primary club head body and the secondary body showing an alternate connection structure.
Figure 5:
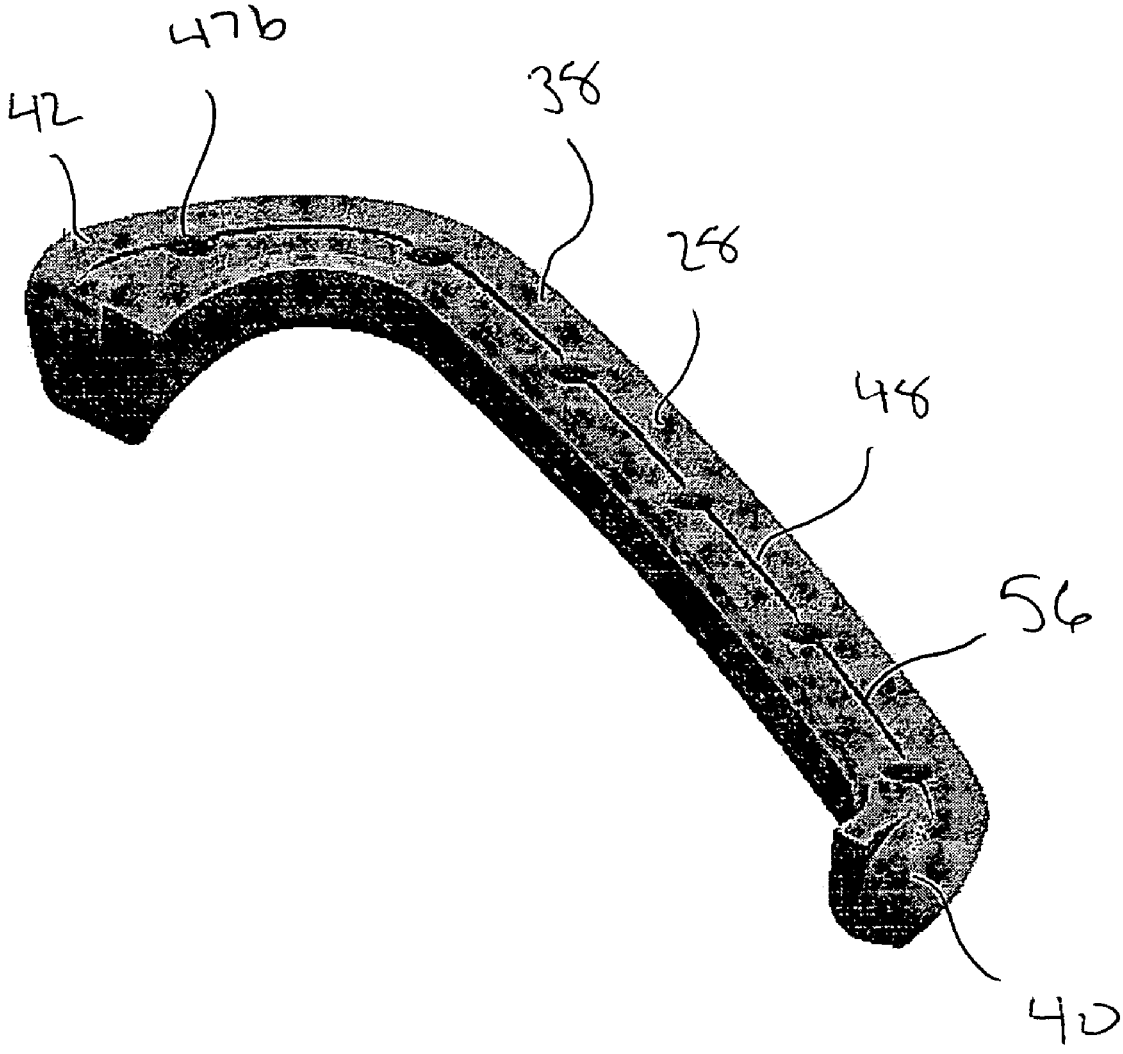

The secondary body 48 is secured to the remainder of the club head body, that is, the primary body 46, by adhesive; thereby creating a composite club head body 14 composed of the primary body 46 and the secondary body 48. Referring to FIG. 2, and in accordance with a preferred embodiment, the primary body 46 includes a recessed section 50 in which the secondary body 48 is mounted. The recessed section 50 is composed of a substantially flat facing wall 52 upon which the secondary body 48 is mounted. The recessed section 50 further includes an engagement lip 54 extending transversely from the facing wall 52. That is, the recessed section 50 is defined by the facing wall 52 substantially parallel to the striking face 16 and a lip 54 along at least a portion of the rear surface 26 and extending transverse to and adjacent to the facing wall 52. The primary body 46 is, therefore, narrowed adjacent the recessed section 50 and the distance between the striking face 16 and the recessed section 50 is approximately 0.060" to approximately 0.275".

In accordance with a preferred embodiment of the present invention, the secondary body 48 will extend along the upper 65% of the striking face 16.

Similarly, the secondary body 48 includes a forward surface 56 abutting the facing wall 52 and a coupling surface 58 extending transverse and adjacent to the forward wall 52. The coupling surface 58 is shaped and dimensioned for substantial alignment with the lip 54 along the facing wall 52 of the primary body 46 of the club head 12.

As discussed above, the secondary body 48 is secured to the primary body 46. In accordance with a preferred embodiment, this is achieved using a combination of adhesive and mechanical connection structures. As those skilled in the art will certainly appreciate, alignment pins, ledge structures, dovetail structures, and positive/negative keying structures, as well as a variety of other known mechanical connecting structures, may be employed within the spirit of the present invention. For example, and with reference to another preferred embodiment disclosed with reference to FIGS. 4 and 5 (similar reference numerals are used to designate elements similar to those found in FIGS. 1, 2 and 3), the primary body 46 is provided with male members 47*a* along the facing wall 52 and the secondary body 48 is provided with female members 47*b*. These are used in conjunction with adhesive to securely and accurately mount the secondary member 48 upon the primary member 46.

In accordance with a preferred embodiment of the present invention, the adhesive is liquid adhesive offering sufficient strength to handle the rigors associated with regularly hitting a golf ball. Although a preferred adhesive is disclosed in accordance with a preferred embodiment of the present invention, other mechanisms for securing the secondary body 48 to the remainder of the primary body 46 may be employed without departing from the spirit of the present invention.

As briefly discussed above, the primary body 46 of the club head 12 is manufactured from metals in a traditional manner. As such, the primary body 46 may be manufactured from various materials utilizing various techniques known to those skilled within the art, including, but not limited to, casting and forging.

By forming the upper section 28 of the club head 12 from a polymeric material, the weight of the club head 12 along the top line 18 of the club head 12 is reduced. This reduction in weight along the upper section 28 of the club head 12 ultimately shifts the center of gravity downwardly toward the sole portion 20 of the club head 12. In fact, one may replace the weight loss along the upper section 28 by adding weight along the lower section 30 and the middle section 32, thereby further shifting the center of gravity toward the sole portion 20 of the club head 12.

By shifting the center of gravity in this manner, the present club head 12 is easier to hit but does not offer the visual distractions associated with a golf club head departing from the traditional design utilized with cavity back golf club heads.

In accordance with a preferred embodiment of the present invention, the enhanced weighting achieved through the implementation of the present invention produces a club head 12 having a total weight in the range of approximately 200 g to approximately 310 g. The weight of the secondary body 48 will be such that it accounts for at most approximately 50% of the club head weight and, more specifically, approximately 2% to approximately 20% of the total club head weight. For example, where the secondary body 48 is at most approximately 50% of the total club head weight a 300 g club head 12 may have a secondary body 48 with a mass of approximately 150 g. More preferably, the secondary body 48 will have a mass of approximately 4 g to approximately 60 g depending upon the mass of the club head 12 and the specific application being considered for the club head 12.

Referring to FIG. 6, the club head 12 has a center of gravity positioned at Y=0.200" to 0.680", Z=0.075" to 0.700" and X=0.750" to 1.750", wherein the XYZ coordinates are set from the hosel center line and the ground intersection plane, Y being the vertical center of gravity (CG) height measured from the ground plane, Z being the horizontal depth of the CG measured from a vertical plane tangent through the hosel center line and generally parallel with the leading edge of the face, and X being the lateral distance from a vertical plane about the intersection of the hosel center line and the ground plane. The striking face 16 of the club head will have an area of approximately 2 $in^2$ to approximately 7 $in^2$.

Further still, and in accordance with a preferred embodiment of the present invention, the material of the secondary body 48 will have a density of approximately 0.250 $g/cm^3$ to approximately 4.000 $g/cm^3$ and the material of the primary body 46 will have a density of approximately 4.000 $g/cm^3$ to approximately 9.000 $g/cm^3$.

Figure 8:
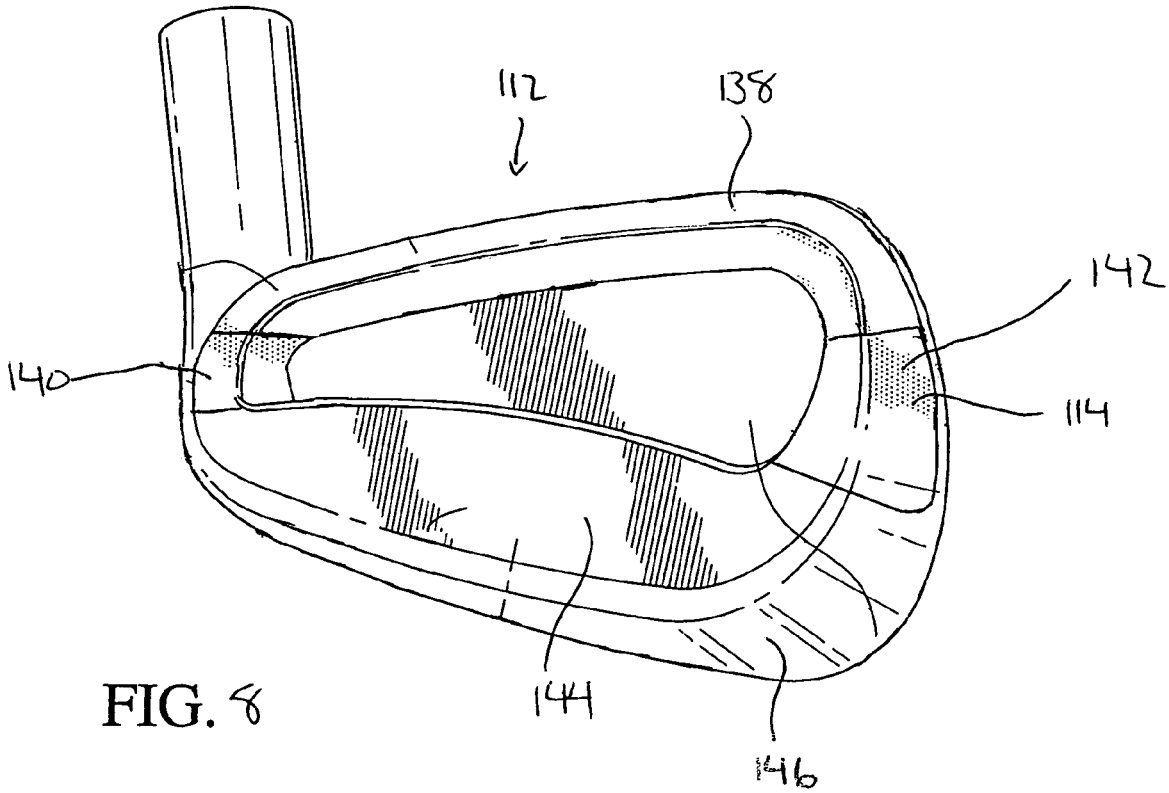
FIG. 8 is a rear perspective view of the present club head in accordance with an alternate embodiment.

In accordance with an alternate embodiment of the present invention, and with reference to FIG. 8, the club head 112 may be formed with a middle section 114 composed of a polymeric material as opposed to the upper section. With such a construction, the heel flange 140 and the toe flange 142 would be composed of the polymeric material and the top and bottom flanges 138, 144, would be composed of the primary club head body 146. Such an alteration would permit shifting of weight in potentially desirable configurations previously unappreciated within the golf industry.

Functionality of the present club head 12 is further improved by altering the sole thickness 60 as a function of the club head loft. More particularly, the sole thickness 60, as measured along the ground plane (that is, the visible sole thickness), is related to the loft angle to enhance the functionality of the present club head 12. More particularly, and as those skilled in the art will certainly appreciate, the sole thickness 60 is measured from the striking face 16 to the rear portion 26 (in the case of a preferred embodiment including the bottom flange 44) of the club head 12 along a line substantially perpendicular to the striking face 16 and at the thickest portion of the visible sole.

As such, when a set of iron type club heads are manufactured in accordance with the present invention, the sole thicknesses of the various club heads making up the set will vary depending upon loft of the club head. In accordance with a preferred embodiment of the present invention, the loft angle relates to the sole thickness in the following manner.

| Loft Range | Sole Thickness Range (inches) |
|---|---|
| 16°–28° | 1.625–2.975 |
| 28°–32° | 0.900–1.200 |
| 32°–36° | 0.925–1.225 |
| 36°–40° | 0.950–1.250 |
| 40°–44° | 0.975–1.275 |
| 44°–50° | 1.000–1.300 |

Figure 7:
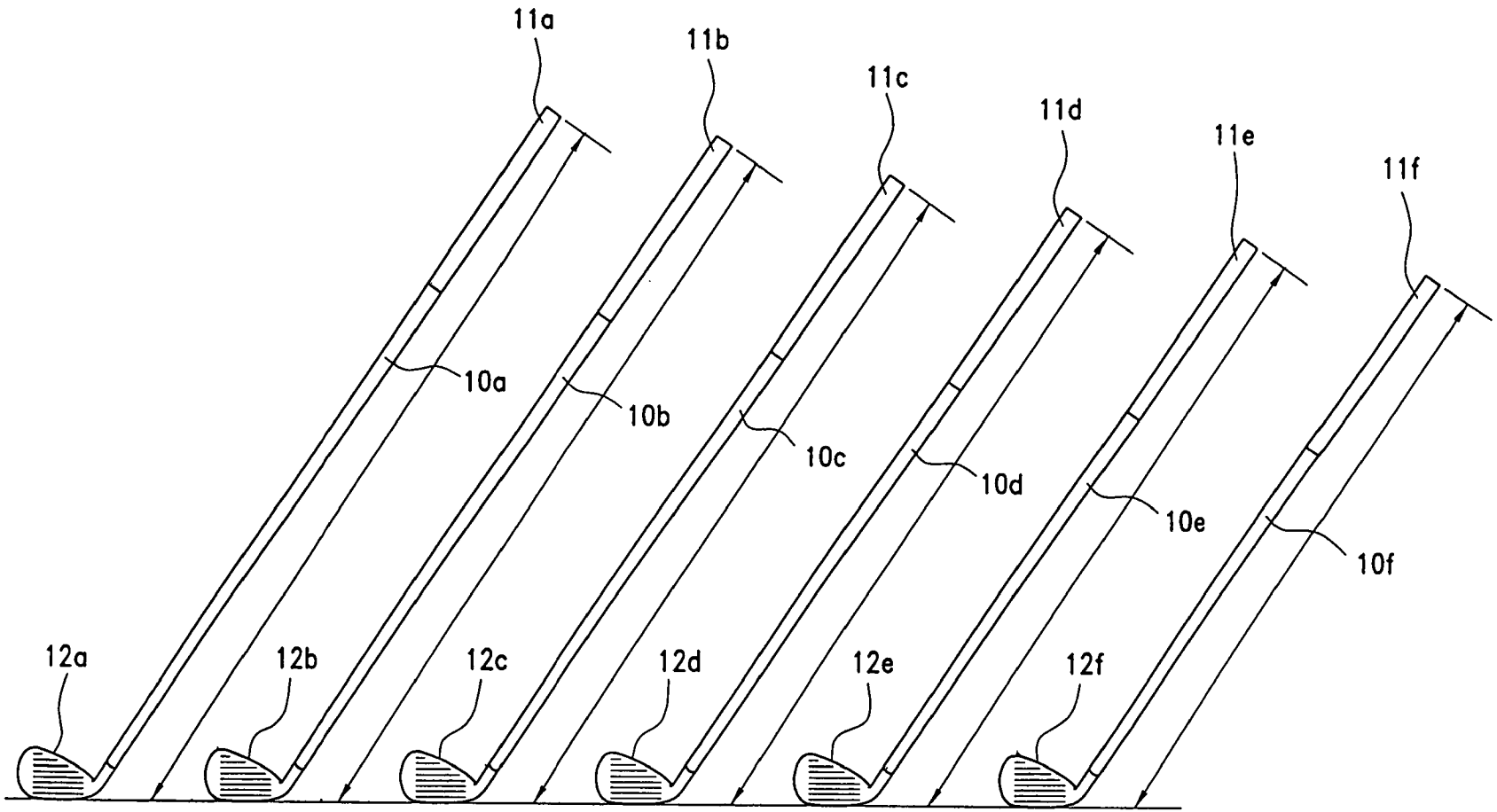
FIG. 7 is a perspective view of a set of golf clubs in accordance with the present invention.

Referring to FIG. 7, a set of iron type golf clubs 10 in accordance with the present invention are disclosed. Each of the golf clubs 10*a–f* includes a shaft 11*a–f* and a club head 12*a–f*, and each club head 12*a–e* is constructed in the manner described above with reference to FIGS. 1 and 2. However, and as discussed above, the loft angle of each club head 12*a–f* is related to the sole thickness of the club head 12*a–f*. A such, the set includes at least one club head 12*a* having a loft angle between approximately 16° and 28° and a sole thickness between approximately 1.625 inches and 2.975 inches, at least one club head 12*b* having a loft angle is between approximately 28° and 32° and a sole thickness between approximately 0.900 inches and 1.200 inches, at least one club head 12*c* having a loft angle between approximately 32° and 36° and a sole thickness between approximately 0.925 inches and 1.225 inches, at least one club head 12*d* having a loft angle is between approximately 36° and 40° and a sole thickness between approximately 0.950 inches and 1.250 inches, at least one club head 12*e* having a loft angle between approximately 40° and 44° and a sole thickness between approximately 0.975 inches and 1.275 inches, and at least one club head 12*f* having a loft angle is between approximately 44° and 50° and a sole thickness between approximately 1.000 inches and 1.300 inches.

It is further contemplated that a tungsten weight, or other weight member, may be positioned within the sole. The inclusion of a tungsten weight will further enhance the weight distribution and limit the necessary sole thickness.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. A set of iron type golf clubs, comprising:

a plurality of iron type golf clubs, each iron type golf club including a shaft and a club head secured thereto, wherein each club head includes:

a primary club head body composed of metal having a first density the primary club head body including a striking face having a loft angle, a facing wall opposite the striking face and a sole extending between the striking face and a rear portion of the primary club head body:

a secondary body secured to the facing wall of the primary club head body, the secondary body having a second density that is less than the first density of the primary club head body; and wherein the loft angle is between approximately 16° and 50° and the sole thickness is between approximately 0.900 inches and 2.975 inches, and at least one club head has a loft angle is between approximately 16° and 28° and the sole thickness is between approximately 1.625 inches and 2.975 inches; at least one club head has a loft angle is between approximately 28° and 32° and the sole thickness is between approximately 0.900 inches and 1.200 inches; at least one club head has a loft angle is between approximately 32° and 36° and the sole thickness is between approximately 0.925 inches and 1.225 inches; at least one club head has a loft angle is between approximately 36° and 40° and the sole thickness is between approximately 0.950 inches and 1.250 inches; at least one club head has a loft angle is between approximately 40° and 44° and the sole thickness is between approximately 0.975 inches and 1.275 inches; at least one club head has a loft angle is between approximately 44° and 50° and the sole thickness is between approximately 1.000 inches and 1.300 inches.

* * * * *